United States Patent [19]

Schickedanz

[11] 4,130,987

[45] Dec. 26, 1978

[54] TIMEPIECE

[76] Inventor: Willi Schickedanz, Langener Strasse 70, 605 Offenbach am Main, Fed. Rep. of Germany

[21] Appl. No.: 689,645

[22] Filed: May 26, 1976

[30] Foreign Application Priority Data

Jun. 10, 1975 [DE] Fed. Rep. of Germany ..... 2525694

[51] Int. Cl.[2] ..... G04B 19/34

[52] U.S. Cl. ..... 58/50 R; 58/4 A; 58/23 R; 58/127 R

[58] Field of Search ..... 58/4 A, 23 R, 23 BA, 58/50 R, 127 R, 85.5; D10/30, 31, 32, 38

[56] References Cited

U.S. PATENT DOCUMENTS

| | | | |
|---|---|---|---|
| 3,626,410 | 12/1971 | deKoster | 58/23 R X |
| 3,668,861 | 6/1972 | Mitsui | 58/50 R |
| 3,672,155 | 6/1972 | Bergey et al. | 58/85.5 X |
| 3,754,392 | 8/1973 | Daniels | 58/127 R X |
| 3,757,511 | 9/1973 | Burgess et al. | 58/50 R |
| 3,772,874 | 11/1973 | Lefkowitz | 58/50 R |
| 3,838,566 | 10/1974 | O'Connor et al. | 58/85.5 X |

FOREIGN PATENT DOCUMENTS

| | | | |
|---|---|---|---|
| 880121 | 10/1961 | United Kingdom | 58/23 BA |

*Primary Examiner*—Ulysses Weldon
*Attorney, Agent, or Firm*—Michael J. Strirker

[57] ABSTRACT

A watch is provided with means for displaying time and date and day of the week etc. by means of liquid crystal elements or the like. The display elements are distributed regularly over tape-like means of almost uniform thickness together with means for generating time standard impulses, means for applying energy etc. Thus, a watch will be obtained which is not separated into a bracelet and a case of a wrist watch or into a clockwork and a display area, respectively. The display area is, on the contrary, dispersed all over the surface of a bangle or means having a similar form.

28 Claims, 9 Drawing Figures

TIMEPIECE

BACKGROUND OF THE INVENTION

The present invention relates to a timepiece, and more particularly to a timepiece for displaying seconds, minutes, hours etc. and comprising means for generating time standards, means for producing different time units, e.g. seconds and minutes, from said time standards and means for displaying said different time units.

In the art, analog and digital watches are well-known. Analog watches usually comprise a dial piece and seconds, hour and minute hands, whereas light emitting diode elements or liquid crystal elements are employed as display elements of digital electronic watches. These elements put together different digits and numbers, thus displaying seconds, minutes, hours, morning and afternoon indications, date and day of the week, number of the week etc. The analog and digital watches, however, have a dial piece in common which includes either the hands or the numbers. Although this dial piece may be a circular or a quadratic or a rectangular one, it is, in any case, a formation the length of which does not differ very much from its width.

A wrist watch for extraordinary length/width-relationship is known from the French Patent No. 1,516,891. This patent describes a elongated watch case being adapted to the wrist and comprising several windows on its surface, behind each of which digits or numbers will appear. These digits or numbers are moved by a mechanism which is, in turn, moved by a clockwork. Thus, the windows show different numbers, the one representing minutes and the other representing hours, for example. However, even this well-known watch is conventional insofar as it is divided into two parts, one part being the watch case and the other being the bracelet.

Another wrist watch having liquid crystal display elements and the capability of displaying second, minute, hour, morning and afternoon indications, date and day of the week, is shown in U.S. Pat. No. 3,738,099. In opposition to the above mentioned watch it works electronically and not mechanically. The calendar display includes a plurality of liquid crystal elements arranged in a matrix form having seven columns each representing the weeks of the months. However, this watch, too, is divided into a watch case having a display area and a bracelet. The main difference between this watch and other well-known wrist watches lies in the plurality of display elements.

A wrist watch having tape-like means going around the whole bracelet is disclosed in the German Auslegeschrift No. 1 115 192. The bracelet of this watch is excavated and conducts a tape which carries time indicating numbers on its surface. This tape is moved by driving means through the bracelet and it displays the time in a window of said bracelet. Although tape-like means is provided in that watch, the time-displaying area is as small as usual.

Finally, an electronic wrist watch has been disclosed in the German Offenlegungsschrift No. 25 01 234 which corresponds to the U.S. patent application Ser. No. 504,374 having the priority date of Sept. 9, 1974. This watch is a modular construction and not divided into a watch case having a display area and a bracelet. It comprises several chips being arranged in a circle and having different functions. One of these chips is for displaying the time, a second for applying energy, a third for controlling a logic circuit, a fourth for stopping the watch, a fifth for selecting different time zones etc. Thus, one time indicating chip is followed by several functional chips, i.e. the time is displayed only by one chip. Therefore, time display means are located in a relatively small area of the circumference of a tape-like bracelet and cannot be distributed over a larger field.

SUMMARY OF THE INVENTION

Accordingly, it is a general object of the present invention to overcome the disadvantages of the prior art.

It is another object of the invention to provide a timepiece having a broadened time indicating area.

Generally speaking, in accordance with the invention, a watch is provided which is a 3-dimensional body comprising time displaying elements all over the length of this body. These display elements may be controlled by a clockwork singly or in groups. Thus, for example, a wrist watch can be constructed wherein the bracelet itself comprises the whole watch, i.e. wherein no distinction is made between the bracelet and the watch case or the display area, respectively. The 3-dimensional body may be open or closed, rigid or flexible. When being open the watch may have the form of a lineal and be hanged at a wall. It may also be circular and then serve as an open time indicating ring or collar. When being closed the watch may comprise a rigid ring or a flexible hoop having a plurality of members connected by links to each other.

In accordance with the invention the watch is preferably an electronic watch, wherein a 1 Hz signal is produced by dividing the high frequency time standard signal of a standard oscillator by means of divider circuitry. Said 1 Hz signal is then applied to series-connected counters which produce, for example, one minute, one hour, twelve hour (morning and afternoon), day, and week signals, which signals are in turn applied to decoder and driving circuitry for driving liquid crystal displays or light emitting diode displays or the like.

The electronic circuitry as well as the power source of the watch may be distributed all over the 3-dimensional body and thus account for a good deal of the thickness of this body. They may also be incorporated into one or several members of a rigid or elastic 3-dimensional body.

Whereas the well-known conventional wrist-watches comprise a functional watch case and a non-functional watch strap, the watch according to the invention has no such non-functional parts.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
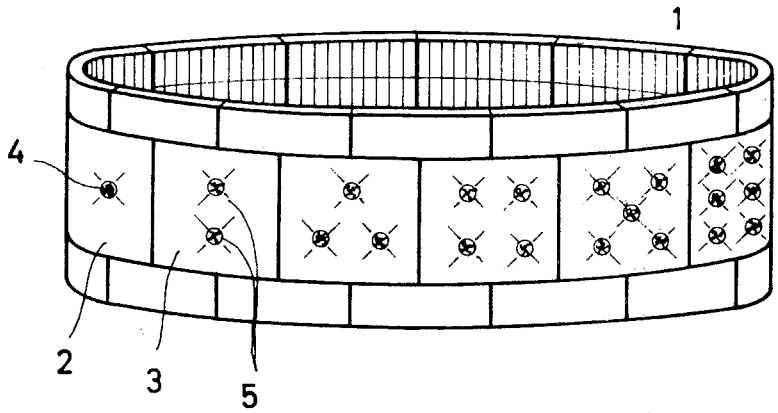
FIG. 1 is an elastic bracelet, the members of which comprise point-like time indicating elements.

Referring now to FIG. 1, the elastic bracelet 1 depicted therein is similar to a conventional elastic metal watch bracelet. The members 2, 3 of this bracelet 1, however, comprise indicating means 4, 5 which indicate time. On a first member 3, for instance, two indicating means 5 are provided. When these means 5 are illuminated, the time will be 2 o'clock or 14 o'clock respectively. To stress the character of the bracelet 1 as a piece of jewellery, the indicating means 4, 5 consist, in combination, of light emitting diodes and polished light-deflecting minerals. Thus, from outside only the minerals are visible, once being illuminated and not being illuminated another time. It is, of course, within the scope of the invention to vary the bracelet shown in FIG. 1 in such a manner as to make it capable for indicating 24 instead of only 12 hours.

Figure 2:
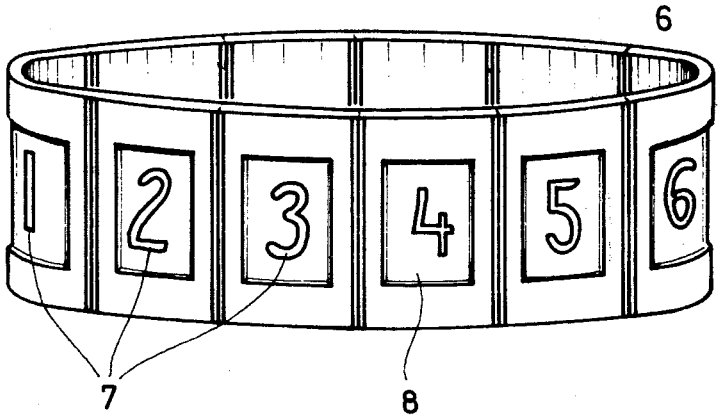
FIG. 2 is an elastic bracelet comprising a plurality of members, each of which includes one number, preferably composed by seven segments.

FIG. 2 shows an elastic bracelet 6 being, in its construction, similar to the bracelet in FIG. 1. The point-like light-emitting elements now are replaced by numbers, i.e. on each member of the bracelet 6 a number or digit, indicating time, is provided. Thus, at 4 a.m. as well as at 4 p.m. the digit "4" lights up. Since each member of the bracelet is connected to a special number or digit, it is not necessary to provide the well-known seven segmental elements. It is sufficient that either the number itself or the area round the number lights up. This may be realized in manifold ways, e.g. putting a lamp and a sprinkling disk behind the area 8, whereby the lamp enlightens the whole area 8. Since in the latter case the number itself is not transparent, time is indicated by the enlightened outer area. It is, of course, possible to design a bracelet for the indication of 24 instead of 12 hours.

To avoid the scratching of the numbers whilst wearing the bracelet, the numbers are arranged somewhat countersunk in relation to the surface of the bracelet.

The bracelet in FIGS. 1 and 2 is sufficiently thick to comprise in an upper layer the time displaying means and in a layer below the energy supply and control circuits. It is well-known in the art to provide control means and energy supply for digital watches (U.S. Pat. Nos. 3,803,834; 3,670,491; 3,729,923; 3,788,059; 2,541,432; 3,116,883; 2,925,706).

Figure 3:
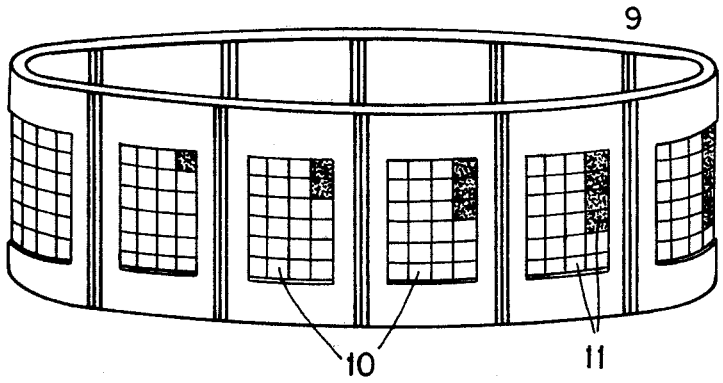
FIG. 3 is a rigid bracelet, the members of which comprise a time indicating area having a plurality of columns and a plurality of rows.

FIG. 3 shows a rigid bracelet 9 having on each of its members an area 10 of 24 small rectangles 11. Each area 10 is associated to one or 2 hours respectively, e.g. 5 a.m. and 5 p.m.

At 4 o'clock four rectangles 11 in a certain member of the bracelet are lighting up. Those of the rectangles 11 which are not shining and thus do do not indicate the time may comprise elements which convert light into electric energy. Thus a new power source is available which, separately or in connection with batteries or accumulators, supplies the time indicating device with sufficient energy. It is, however, well-known in the art to supply watches by means of light converting devices with electric energy (cf. No-battery "solar" powered model, TIME magazine, May 19, 1975; pp. 56, 57).

Figure 4:
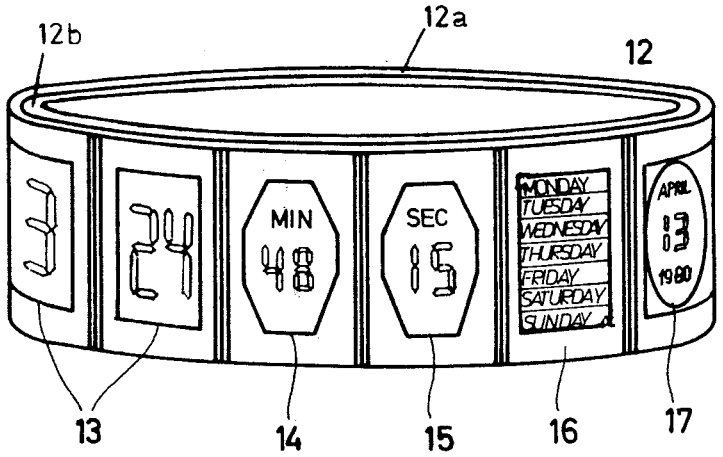
FIG. 4 is a rigid bracelet comprising a second, a minute, an hour, a date, and a day of the week indication.

FIG. 4 shows a bracelet 12 which indicates not only the full hours, but also minutes, seconds, the date, and the day of the week. The hour display can be seen on the left side of the bracelet 12, whereas the minute and second displays 14, 15 are arranged in the middle of the bracelet 12 and the day of the week display 16 as well as the date display 17 are located on the right side of the bracelet 12. The indication of the hour is realized by associating one special hour to one of the members of the bracelet 12. The display of minutes, seconds, and of the date is done by means of seven-segment-display-elements. The area 16 for displaying the days of the week is divided into seven segments which are illuminated successively. The days of the week are visible on each of these segments. Thus, it is easy to recognize the respective day of the week. It is possible, of course, to replace the written names of the days by seven-segment-elements which from, for example, the symbols MON, TUE, WED, THU, FRI, SAT, SUN.

Figure 5:
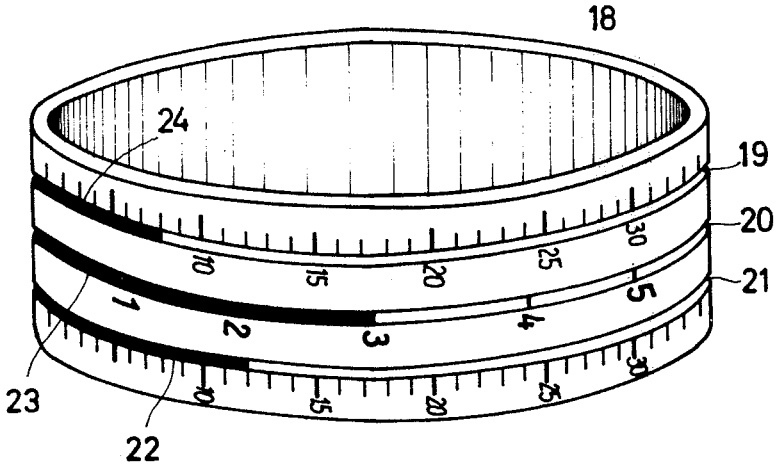
FIG. 5 is a rigid bracelet, having time indicating elements on its circumference, which are capable of indicating the time in a quasi-continuous manner.

A digital time display arrangement having an effect similar to an analog time display is shown by the bracelet 18 of FIG. 5. This bracelet 18 comprises three tracks 19, 20, 21, being provided for the indication of hours, minutes, and seconds. The tracks 19 and 21 are provided with scales which each are divided into sixty units, whereas the scale of track 20 is divided into either twelve or twenty-four units. Each unit is associated to a light emitting element 22, 23, 24. When the light emitting elements are supplied with control signals successively, you get the impression of a quasi-continuous time display. This impression is the more convincing the narrower the division of the light emitting elements is.

The subdivision of the hours of the bracelet 18 according to FIG. 5 is chosen very roughly. Thus, one will have the impression that the hour display — in opposition to the minute and the second display — jumps from one point to the next. It is, of course, possible to divide the track of the hour display into very smalll units so that it is not necessary to provide additional minute and second displays 19, 21. To read off the time as exactly as in the above mentioned case, the track of the hour display should be divided into 3600 units.

Figure 6:
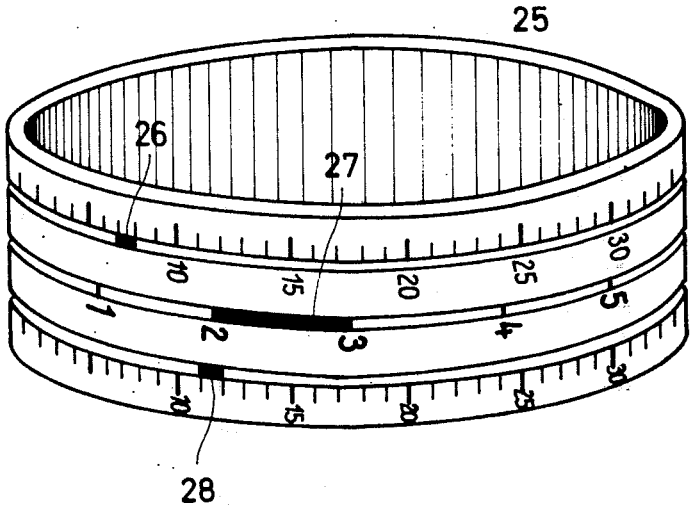
FIG. 6 is a rigid bracelet having three time indicating segments on its circumference.

The bracelet 25 shown in FIG. 6 differs from the bracelet 18 shown in FIG. 5 insofar as the lighting of a light emitting element turns off the light emitting elements which had been turned on before. Thus it is possible to save energy.

The embodiments described herein may be easily improved. For those skilled in the art it is not difficult to provide the circumference of a bracelet with additional time informations, such as the number of the week or the corresponding times of Moskow, Los Angeles, Bombay, Chicago, New York, Montreal, Tokyo, Sidney, Iceland, and Central Europe.

Figure 7:
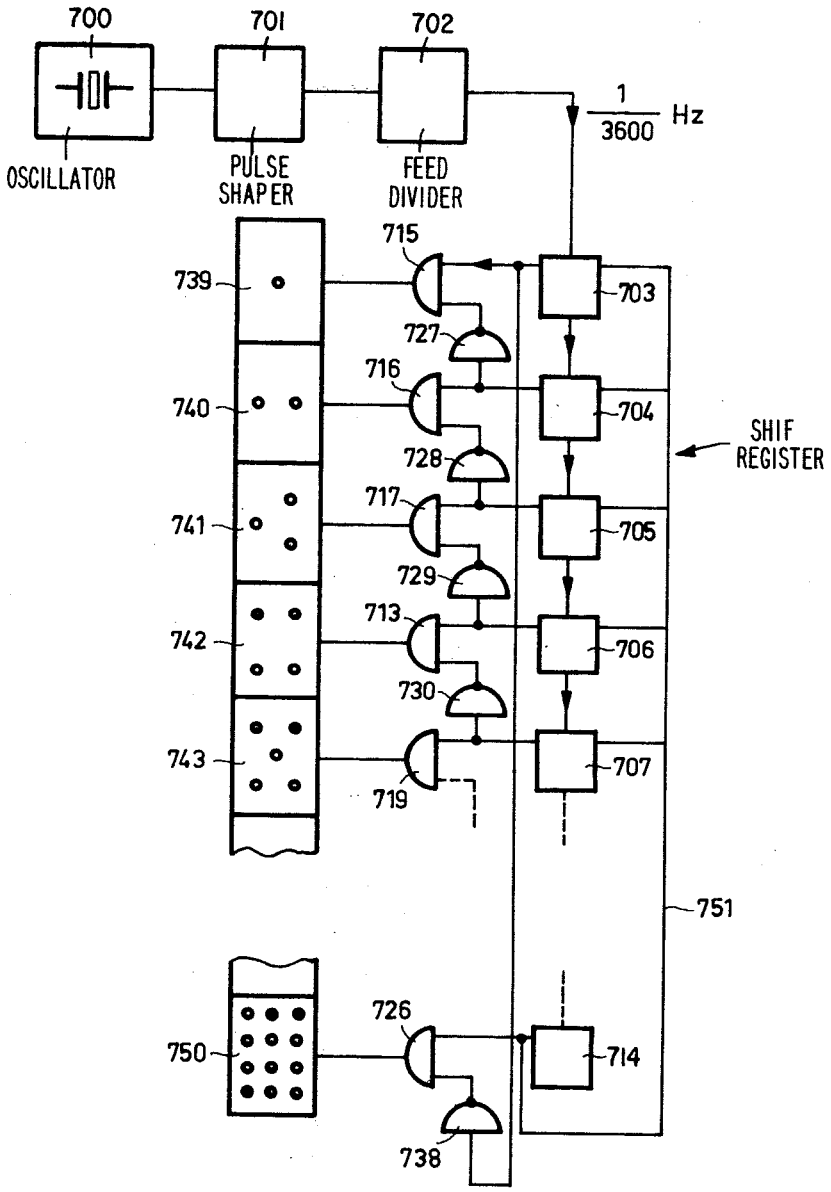
FIG. 7 is a circuit which controls a plurality of hour indicating elements sequentially.

FIG. 7 shows a standard signal generator 700 which comprises a quartz crystal oscillating at a frequency of 32,768 kHz. The signals coming from the standard signal generator 700 are shaped by an impulse forming device into appropriate rectangular pulses and then forwarded to a multi-stage frequency divider 702. Every hour a pulse is put out of that frequency divider 702, i.e. the frequency of the divider is 1/3600 Hz.

It is, of course, possible to provide additional frequency dividers having output frequency of 1/60 Hz or 1 Hz. For an easier understanding, however, FIG. 7 only shows an hour display for twelve hours.

The hour impulse coming from the divider 702 reaches a shift register comprising a plurality of shift elements 703–714. Each of these shift elements 703–714 is associated to an AND-Gate 715–726, respectively, to an inverter 727–738, respectively, and a display element 739–750, respectively.

When the first hour impulse coming from the frequency divider 702 reaches the shift element 703, the display element lights up. This is a consequence of the fact that at the output of the shift element 703 which is connected to the AND-Gate 725 a control signal appears. This control signal is led via the AND-Gate 715 to the display element 739, since the AND-condition is fulfilled. The fulfillment of the AND-condition, in turn, results from the shift element 704 not yet sending an impulse to the AND-Gate 716. Thus, the inverter 727 leads a signal to the second input of the AND-Gate 715.

When the second hour impulse arrives, the signal just being in the shift element 703 is shifted to the shift element 704 and the second hour impulse is stored in the shift element 703. Under normal conditions the display elements 739 and 740 both would light up, since the shift elements 703 and 704 are sending a signal towards the AND-Gates 715, 716. However, since the second input of the AND-Gate 715 is connected to the control output of the shift element 704 via the inverter 727, only the display element 740 lights up.

Each hour impulse thus causes only that display element out of the plurality of display elements 739–750 to light up which corresponds to the respective hour. When the hour impulse reaches the shift element 714 which is co-ordinated to the twelfth hour, the inverter 738 would not be necessary, because there is no thirteenth shift element, the control signal of which had to be inverted. It would thus be sufficient to forward the control signal of the shift element 714 directly to the display element 750. Certainly, when the next hour impulse appears, the display element is extinguished, i.e. switched off. To provide this, first of all the shift elements 703–713 are reset by a signal coming from the reset line 751 by the output of the shift element 714, i.e. the condition of the shift elements is the same as it was before the arrival of the first hour impulse. If now the first hour impulse again appears in the shift element 703, a control signal again is stored. The zero signal in the shift element 714 caused by the resetting procedure is given to the shift element 714 and the display element 750 is switched off. As a test whether or not the display element is switched off, the inverter 738 and the AND-Gate 726 may be provided. Thus, in any case, the display element 750 will be turned off whilst the display element 739 is turned on, even if a control signal is stored in the shift element 714.

The circuit according to FIG. 7 can be applied to the time indicating device according to FIGS. 1, 2, 3. When used in a device as shown in FIG. 3, numbers instead of light emitting points are supplied with electrical signals. These numbers should not be of the seven-segment-type, since each digit or number corresponds exactly to one member of the bracelet as it is. The arrangement according to FIG. 4 is similar to the arrangements shown in FIG. 1 through 3. The single hour elements of a member can be connected to each other in such a manner that they can only light up as a group. It will be appreciated that the embodiment of FIG. 6 differs from that of, for example, FIG. 2, in the fact that three tracks, instead of a single track, are employed. Accordingly, it will be clear that each of the three tracks in FIG. 6 can be controlled by a respective control circuit such as used to control the single track in FIG. 2, i.e., the circuit of FIG. 7, but of course using the appropriate number of shift-register stages and frequency-division factor for the time units associated with each such track.

An extension of the principle shown in FIG. 7 is necessary if, as already mentioned above, not only hours, but also minutes, seconds, the days of the week and the date shall be displayed.

If a device according to FIG. 2 shall comprise additional minute and second displays, on each member 60 digits for the minutes and 3600 digits for the seconds had to be provided, provided that each digit were associated to a minute and/or a second impulse. It is obvious that this way would be impractical. More convenient, however, is a member comprising a seven-segment-display or the like for the relatively high speeded second and minute impulses.

This embodiment is shown in FIG. 4, from which also may be learned that the timepiece comprises a first layer **12*a* comprising power supply means, means for generating time standards and means for converting the time standards into time unit pulses, and that it, moreover, further comprises a second layer 12*b*** comprising time displaying means, said second layer being arranged above said first layer.

The arrangement depicted in FIG. 4 comprises hour indicating digits which are each coordinated to one member and which are to be seen on the left side only. The further time indicating means are visible at the very front of the timepiece. A control circuit for the device according to FIG. 4 is shown in FIG. 8.

Figure 8:
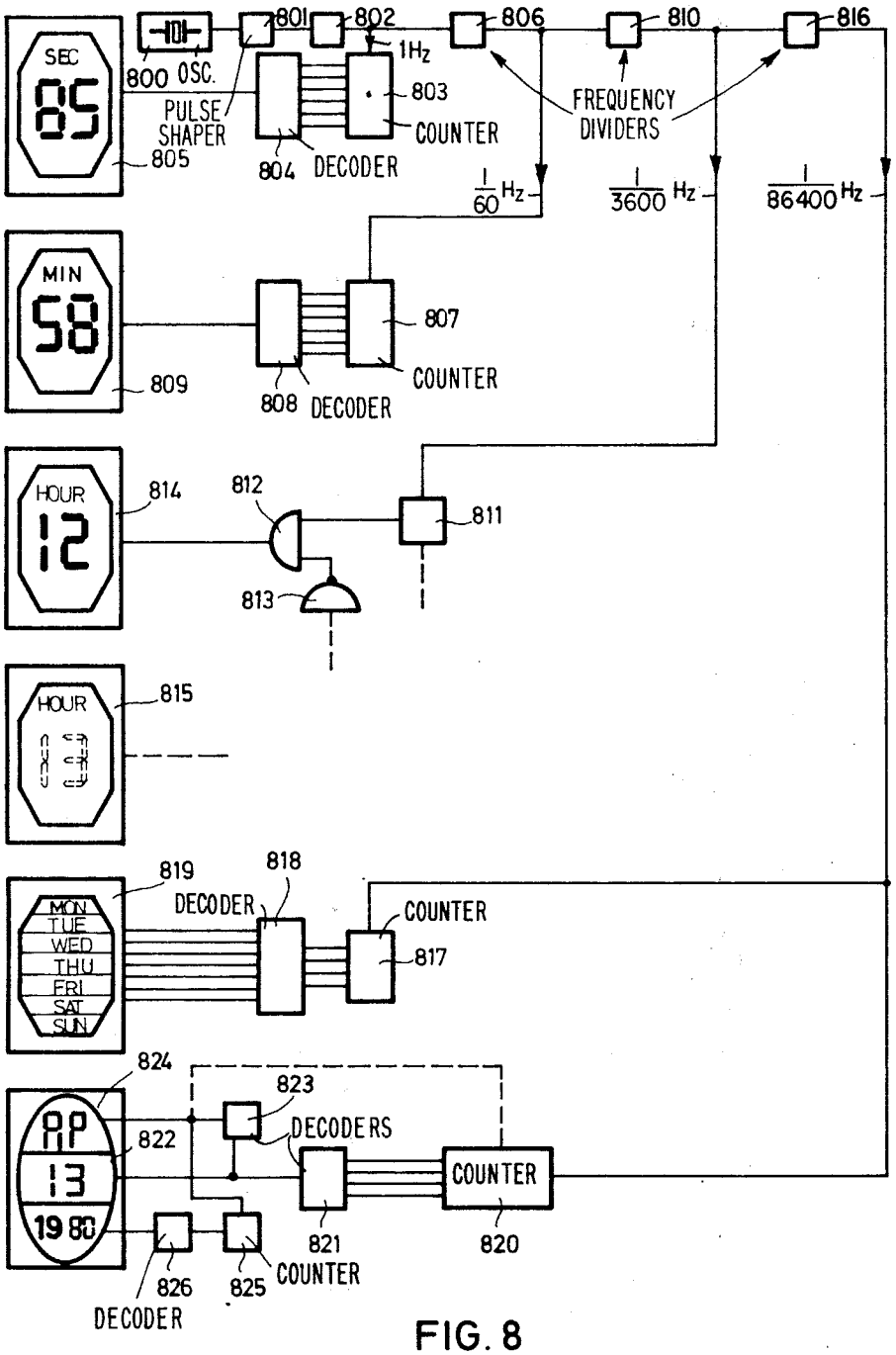
FIG. 8 is a circuit having the capability of controlling a plurality of hour indicating elements as well as a second, a minute, an hour, a date, and a day of the week indications sequentially.

FIG. 8 depicts a quartz pulse generator 800 being connected to a pulse former 801. The pulse former 801 is followed by a multi-stage divider 802 which divides the frequency of the quartz pulse generator to a frequency of 1 Hz. These second impulses are forwarded to a counter 803 which counts up sixty and then again begins to count from the very beginning, i.e. from zero.

In a decoder 804, following the counter 803, the stored information of the counter 803 is converted in such a manner that a seven-segment-display 805 can be controlled by applying said converted information thereto.

The second pulse is led from the divider 803 to a further divider 806 which divides the pulses again in a 1:60 relationship, i.e. it produces one pulse a minute.

This minute pulse is led to a counter 807 which counts to 60, too, and controls a seven-segment-minute-display 809 via a decoder 808. It is also possible to use a decoder instead of a divider 806 which is connected to the output of the counter 803 and which produces a pulse for the counter 807 each time when the counter has reached the number sixty.

The minute pulses of the divider 806 are led to the divider 810 which divides the frequency again in a 1:60 relationship thus producing one pulse every hour. This pulse is forwarded, as already described in connection with FIG. 7, to a shift register, from which only a shift element 811, an AND-Gate 812, an inverter 813 and two display elements 814,815 are shown.

The hour pulses of the divider 810 are led to a further divider 816 which divides the input pulses in a 1:24 relationship and produces one pulse a day on its output.

This pulse is given to a counter 817 which is capable of counting at least up to "seven". A decoder 818 lies in series to the counter 817 and controls the display 819 which comprises the days of the week. The control circuit effects a stripe to light up whereby this stripe indicates a day of the week. Then the pulses corresponding to the days of the week are led to another counter 820. Said counter 820 counts up to 31 and then controls the date display via a decoder 821.

A further decoder 823 is connected to the output of the decoder 821. This decoder 823 is capable of recognizing the number "31" at the output of the decoder 821 when the whole system is at its zero state.

Then a month display 824 is switched from JA (=January) to FE (=February) by the decoder 823. By reason of an internal program the decoder 823 initiates further switching at the next running of the counter 820 when the counter state is at 28 or 29, dependent on the fact whether it is a leap-year or not. Watches having such programs are well-known in the art (see: digital watch "functional" of BRAUN AG, Frankfurt am Main, West-Germany).

Using those programs, it is possible to display always the correct month, although the number of the days of the months differ from each other. Besides this, it is possible to control the counter by a feedback circuit. When, for example, a decoder switches from "February" to "March", the switching pulse is led back to the counter 820 thus bringing the counter into its zero state.

The output of the decoder can also be led to another counter 825 which counts up to the number "12" and then provides a year's pulse. Said year's pulse switches a year's decoder 826 which is programmed for a special year's number, e.g. for the number 80 according to the year 1980, to the next number, i.e. from 1980 to 1981. The number "nineteen" may be fixed, since a watch will probably not be used for more than one century. The year's display can now be controlled by a decoder not shown in the figure.

The power needed for the time display device may be obtained from micro cells which are either provided in special members of a bracelet or combined with time displaying elements, i.e. each member then comprises a time displaying element and an associated micro cell.

The power source is, of course, not limited to micro cells. Quite different sources of electrical energy may be used, such as distributed voltage elements. It is also possible to use photo cells as power sources.

Figure 9:
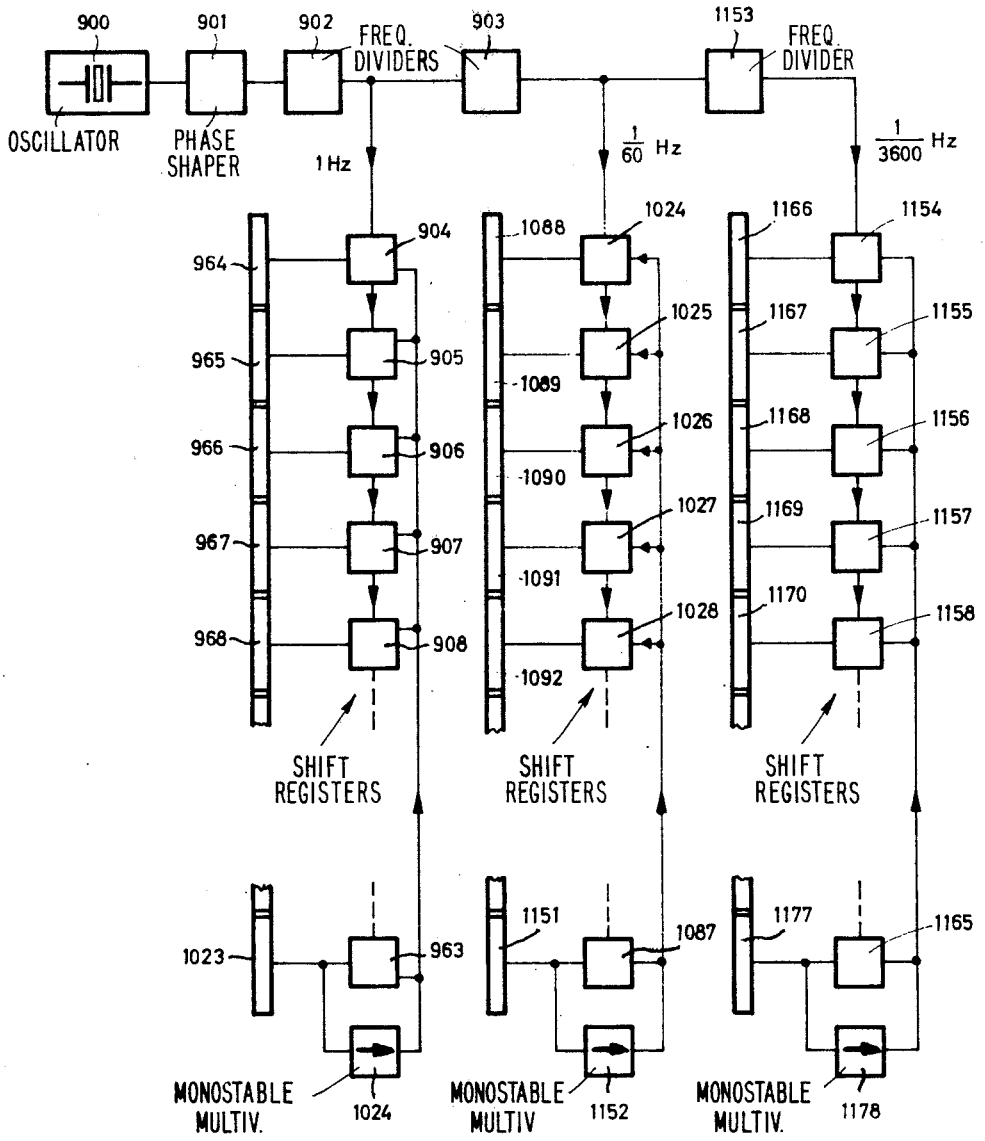
FIG. 9 is a circuit having the capability of controlling a plurality of time indicating elements without extinguishing the elements which had been controlled before.

A circuit adapted to a time display device according to FIG. 5 is shown in FIG. 9.

A quartz frequency generator 900 is followed by a pulse former 901. A multi-stage frequency divider 902 which divides the high frequency of the frequency generator 900 to one second, is connected to a further frequency divider 903 and to a shift register for the seconds, of which only some of the sixty shift elements 904–963 are shown.

Each of these shift elements 904–963 is connected to a light-emitting element, e.g. a light-emitting diode or a liquid crystal cell 964–1023 being combined with a radiation source. Assuming that a second pulse arrives at the shift element 904, this element lights up.

The next second pulse causes the elements 964,965 to light up, and after sixty seconds all light-emitting elements are shining. At the same time when the last light emitting element 1023 lights up, a monostable flipflop 1024 is set which is then reset to its initial state after 9/10 seconds, thereby resetting all shift elements 904–963. The minutes are displayed in a similar way as the seconds. Therefore, shift elements 1024–1087 are provided which control the light emitting elements 1088–1151, whereby the time delay circuit 1152 resets the shift elements.

The hours are, in principal, displayed in the same way. Instead of sixty light emitting elements only twelve or twenty-four elements are provided. These light-emitting elements 1166–1177 are The invention described herein can be combined with all techniques known from digital watches. It is, for example, possible to control the time display elements clockwise in order to serve energy. The clockwise operation may be realized by adapting rules of physiological optics and take into account flicker frequency, threshold phenomena etc., as described in German Patent Application No. P 25 11 930.6.

Resetting and re-adjusting of the dates, what may become necessary after a longer period of not using the watch, may be realized in such a manner that the light pulse frequency coming from an oscillator are used to switch the respective counter or display device. When a digital coded time standard is transmitted by means of wireless signals, antennas and/or receivers may be provided which adjust the time display device to the correct time.

What I claim is:

1. A timepiece comprising means for generating time standards, including an oscillator for producing a high frequency time standard signal; means for converting said time standards into different time unit pulses, including a pulse shaping device and circuit means for dividing said high frequency time standard signal into different time unit pulses; and time displaying means connected to said converting means and being capable of changing their light emitting states in correspondence to said time unit pulses; a plurality of shift registers connected to the time displaying means, said circuit means being connected to one out of said plurality of shift registers, whereby during the supply of one of said time displaying means those time displaying means which had been supplied before are switched off, and further including an AND-gate connected between a shift element of one of said plurality of shift registers and the corresponding time displaying means, the first input of said AND-gate being connected to the output of said shift element and the second input of said AND-gate being connected to the output of the following shift element via an inverting gate.

2. A timepiece comprising, in combination, means defining an at least approximately closed annular wrist band; a plurality of electrically controllable display units distributed in circumferential succession about substantially the entirety of the annular wrist band; and circuit means operative for generating a time reference signal, converting the reference signal into time unit pulses and in dependence upon the time unit pulses controlling the operation of the display units.

3. A timepiece as defined in claim 2, the annular wrist band being a completely closed annular band.

4. A timepiece as defined in claim 3, the closed annular wrist band being a flexible and stretchable annular wrist band.

5. A timepiece as defined in claim 2, the annular wrist band being a rigid wristband.

6. A timepiece as defined in claim 2, the display units comprising at least 12 hour-display display units each operative for effecting the display of a respective hour of the day, the at least twelve hour-display display units being arranged in circumferential succession about substantially the entirety of the annular band.

7. A timepiece as defined in claim 6, each one of 12 of the hour-display display units being operative only for displaying a different respective one of the integers 1, 2, 3, 4, 5, 6, 7, 8, 9, 10, 11 and 12.

8. A timepiece as defined in claim 6, each one of twelve of the hour-display display units being provided with a different respective number of spatially distinct display areas, the circuit means comprising means operative in dependence upon the time unit pulses for causing all the display areas of successive individual ones of the hour-display display units to become operative and remain operative for only one respecive hour of a twelve-hour succession, whereby the user of the timepiece by seeing first which hour-display display unit is in operation and then by seeing the number of spatially distinct display areas within that unit is informed of the hour of the day.

9. A timepiece as defined in claim 6, the circuit means comprising means operative for causing successive individual ones of the hour-display display units to become operative and remain operative for only one respective hour of a 12 -hour succession.

10. A timepiece as defined in claim 6, each one of twelve of the hour-display display units being provided with a plurality of spatially distinct zones, the number of spatially distinct zones being the same for all the display units, the number of zones within each hour-display display unit actually utilized for display being different from one display unit to the next and increasing from 1 to 12 when proceeding from one unit to the next, the circuit means comprising means operative in dependence upon the time unit pulses for causing all the actual display zones of successive individual ones of the hour-display display units to become operative and remain operative for only one respective hour of a twelve-hour succession.

11. A timepiece as defined in claim 10, the zones of each hour-display display unit being arranged in rows and columns, the arrangement of zones being the same for each one of the hour-display display units.

12. A timepiece as defined in claim 11, at least some of the zones not constituting display zones instead being light-responsive energy-conversion devices operative for furnishing electrical energy to said circuit means.

13. A timepiece as defined in claim 2, the display units comprising a plurality of circumferentially successive display units each operative for displaying a different respective unit of time.

14. A timepiece as defined in claim 13, the different respective units of time including minute of the hour, second of the minute, and day of the month.

15. A timepiece as defined in claim 14, the different respective units of time further including month of the year.

16. A timepiece as defined in claim 13, the display units additionally comprising a plurality of circumferentially successive hour-display display units, each hour-display display unit being operative for displaying one respective hour of a succession of hours.

17. A timepiece as defined in claim 16, those display units which display different respective units of time including a minutes-display display unit and a seconds-display display unit both comprised of seven-segment display elements.

18. A timepiece as defined in claim 16, those display units which display different respective units of time further including a day-of-the-week display unit provided with seven spatially distinct display zones for indicating the day of the week.

19. A timepiece as defined in claim 16, those display units which display different respective units of time further including a day-of-the-month display unit operative for indicating the day of the month.

20. A timepiece as defined in claim 2, the display units comprising a plurality of seconds-display display units arranged in circumferential succession around the wrist band and forming a track, the circuit means comprising means operative in dependence upon the time unit pulses for causing successive ones of the seconds-display display units to become operative to create a visible indication which circulates around the wrist band once per minute.

21. A timepiece as defined in claim 20, the means for causing successive ones of the seconds-display display units to become operative comprising means for causing an operative display unit to become inoperative when the next display unit is rendered operative, whereby to create within said track a visible indication of constant length measured in the direction along said track which circulates along said track around the wrist band once per minute.

22. A timepiece as defined in claim 20, the means for causing successive ones of the seconds-display display unit to become operative comprising means for causing each seconds-display display unit rendered operative to remain operative for a different respective time interval to create within said track a visible indication which during the course of one minute grows in length and extends about an increasingly greater portion of the circumference of the wrist band.

23. A timepiece as defined in claim 2, the display units comprising a circumferential succession of hour-display display units extending around the circumference of the wrist band in a track, a circumferential succession of minute-display display units extending around the circumference of the wrist band in a track, and a circumferential succession of seconds-display display units extending around the circumference of the wrist band in a track, the circuit means comprising means operative in dependence upon the time unit pulses for causing successive ones of the display units in the respective tracks to become operative to create visible indications of hours, minutes and seconds each of which circulates around the wrist band.

24. A timepiece as defined in claim 23, the means for causing successive ones of the display units in said tracks to become operative comprising means for causing an operative display unit in one of said tracks to become inoperative when the next display unit in the track is rendered operative, whereby to create within the track a visible indication of constant length measured in the direction along the track which circulates along the track around the wrist band in cycles.

25. A timepiece as defined in claim 23, the means for causing successive ones of the display units in said tracks to become operative comprising means for causing each display unit rendered operative in one of said tracks to remain operative for a different respective time interval relative to the other units of the same track to create within the track a visible indication which grows in length and extends about an increasingly greater portion of the circumference of the wrist band.

26. A timepiece as defined in claim 23, the wrist band being provided with calibrated markings extending along said tracks.

27. A timepiece as defined in claim 2, the display units including cooperating liquid-crystal elements and light sources.

28. A timepiece as defined in claim 2, the display units including light-emitting diodes and refracting elements.

* * * * *